US008033391B1

(12) United States Patent
D'Abusco

(10) Patent No.: US 8,033,391 B1
(45) Date of Patent: Oct. 11, 2011

(54) MOISTURE-ABSORBANT PADDING FOR USE IN COMBINATION WITH A PIZZA BOX AND ASSOCIATED METHOD

(76) Inventor: Lorenzo Scotto D'Abusco, Staten Island, NY (US)

( * ) Notice: Subject to any disclaimer, the term of this patent is extended or adjusted under 35 U.S.C. 154(b) by 0 days.

(21) Appl. No.: 12/579,434

(22) Filed: Oct. 15, 2009

(51) Int. Cl.
*B65D 81/24* (2006.01)

(52) U.S. Cl. ..... 206/204; 229/906

(58) Field of Classification Search ..... 206/204; 229/906, 237; 428/131, 137; 137/215, 216, 137/216.1
See application file for complete search history.

(56) References Cited

U.S. PATENT DOCUMENTS 2,994,404 A * 8/1961 Schifferly ..... 96/117.5
5,385,292 A 1/1995 Labianca
5,454,471 A 10/1995 Norvell
5,934,773 A * 8/1999 Ferrell ..... 312/31.1
6,932,267 B2 * 8/2005 Potenza et al. ..... 229/199
7,005,035 B2 2/2006 O'Neill
2006/0144726 A1 * 7/2006 Foust et al. ..... 206/204
* cited by examiner

*Primary Examiner* — Mickey Yu
*Assistant Examiner* — Chun Cheung

(57) ABSTRACT

A moisture-absorbent padding used in combination with and for lining a food product container, such as a pizza box, includes parallelepiped strips each having a cavity therein and a moisture-absorbent material within the cavity. The strips further have vertically oriented monolithic orifices disposed within a front wall of each strip. The orifices open into the cavity and absorb moisture released from a food product stored within the container. The apparatus may also include a laterally flanging parallelepiped reservoir downwardly and angularly disposed on each side of each orifice which collects moisture seeping away from the moisture-absorbent material. An adhesive material on the rear wall attaches each strip to an inside edge of an outer wall of the food container.

5 Claims, 4 Drawing Sheets

MOISTURE-ABSORBANT PADDING FOR USE IN COMBINATION WITH A PIZZA BOX AND ASSOCIATED METHOD

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to padding accessories and, more particularly, to a moisture-absorbent padding for use in combination with a cardboard pizza box for preventing pizza from becoming soggy prior to human consumption.

2. Prior Art

In the field of padding hot carry-out food, such as pizza, a common goal has been to protect the food by maintaining a desirable high food-temperature and retaining the desirable characteristics and quality of the particular food, such as, in the case of pizza, a crispy crust. One particular problem is controlling the release of water vapor (steam) from the package without losing heat from the food. If the steam is not released from the package, it will generally condense within the package, eventually soaking the food item, and resulting in a loss of both product crispness (e.g., the pizza crust will become soggy) and product quality.

For the most part, the prior art relies on a combination of vents, formed within the walls of the package to release any steam from the food, and tabs which raise the food above a bottom surface of the package. Although these prior art methods and structures may be effective in removing steam from the package, they fail to maintain adequate food temperature. Too much convection within the package draws too much heat from the food, resulting in a cold, albeit crispy food product. Further, without adequate support a product, such as a pizza, may collapse, particularly when the crust becomes soggy.

Accordingly, a need remains for a moisture and steam absorbing article for pizza pie containers and the like in order to overcome the above-noted shortcomings. The present invention satisfies such a need by providing an apparatus that is convenient and easy to use, is durable yet lightweight in design, is versatile in its applications, and provides users with a simple and effective means of keeping a pizza crispy and fresh while in transport.

The present invention satisfies such a need by providing a hat insert that is convenient and easy to use, is durable yet lightweight in design, is versatile in its applications, and which provides a flexible strip having an absorbent deodorized inner layer and including a bilaterally symmetrical trapezoidal upper portion and mirror image lower portion attached together with a connection band which folds along a center longitudinal axis to cover a hat inner band.

BRIEF SUMMARY OF THE INVENTION

In view of the foregoing background, it is therefore an object of the present moisture-absorbent padding apparatus to provide a lining for a food product container, such as a pizza box, including semi-flexible parallelepiped strips each having a cavity therein and a moisture-absorbent material within the cavity, and further having vertically oriented monolithic orifices disposed within a front wall of each strip. The orifices open into the cavity and absorb moisture released from a food product stored within the container.

The apparatus may also include a laterally flanging parallelepiped reservoir downwardly angularly disposed on each side of each orifice which collects moisture also. An adhesive material on the rear wall attaches each strip to an inside edge of an outer wall of the food container.

The strips are directly attached, without the use of intervening elements, to the inside edge of the container outer wall that is suitably sized and shaped to hold pizza pies. Of course, the container may be alternately shaped for holding a variety of alternate foodstuff, as is obvious to a person of ordinary skill in the art. The strips effectively function to capture rising steam, which is essential for preventing the condensation of such steam onto the foodstuff, allowing the pizza pie to remain deliciously crispy.

The absorbent strips are produced of a durable absorbent material, like cotton or similar material. The strips may measure about six inches (6") in length, about six inches (6") in width, and about one quarter of an inch (¼") in depth. In another embodiment of the apparatus, the strip may have a length in a range of about 6 inches to about 18 inches, a width of about 3 inches to about 9 inches, and a depth in a range of about ⅛ inch to about ½ inch.

In one embodiment, the strips may be disposed adjacent to each other forming a sheet and separated by a plurality of perforations through the sheet. Thus, a strip which best conforms to a container outer wall inside edge may be torn from the sheet and attached to the inside edge to line the container.

The orifices are vital for allowing the steam to enter the strips, and condensate therein as opposed to condensing onto the foodstuff.

The rear wall of each strip is covered with a heavy duty, adhesive material, which is important for attaching the absorbent strips onto the interior surface of the container, centrally positioned on the underside of the box lid. Of course, the absorbent strips could be produced in a variety of alternate dimensions for lining the sides of the lid, providing more absorbing power, and for lining alternately sized foodstuff containers, as is obvious to a person of ordinary skill in the art. The absorbent strips are conveniently attached to the interior surface of a pizza pie container at point of manufacture. Of course, the strips could be offered as an aftermarket item that can be placed in the boxes at the time hot foodstuff is inserted, as is obvious to a person of ordinary skill in the art.

In use, the moisture and steam absorbing article for pizza pie containers and the like is simple and straightforward to operate. As described above, the strips are adhered to the interior surface of a container lid. While the boxed pizza pie is transported the absorbent strips effectively captures the rising steam within the absorbent material, keeping it there and away from the food, while advantageously maintaining the raised temperature within the container. In this manner, the person who ordered the pizza pie opens the container he or she is confronted with a crispy, oven-fresh favorite that is ready and suitable for consumption.

The apparatus of this invention is referred to generally in the figures and is intended to provide a moisture and steam absorbing article for pizza pie containers and similar containers. It should be understood that the apparatus may be used to absorb steam and moisture in many different kinds of foodstuff containers and should not be limited in use to pizza pie containers.

These objects and other objects, features and advantages of the invention are provided by moisture-absorbent padding apparatus now present in the prior art, the general purpose of the present moisture-absorbent padding apparatus, described subsequently in greater detail, is to provide a moisture-absorbent padding apparatus which has many novel features that result in a moisture-absorbent padding apparatus which is not anticipated, rendered obvious, suggested, or even implied by prior art, either alone or in combination thereof.

There has thus been outlined, rather broadly, the more important features of the present moisture-absorbent padding apparatus in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE DRAWINGS

The present invention will now be described more fully hereinafter with reference to the accompanying drawings, in which a preferred embodiment of the present moisture-absorbent padding apparatus is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
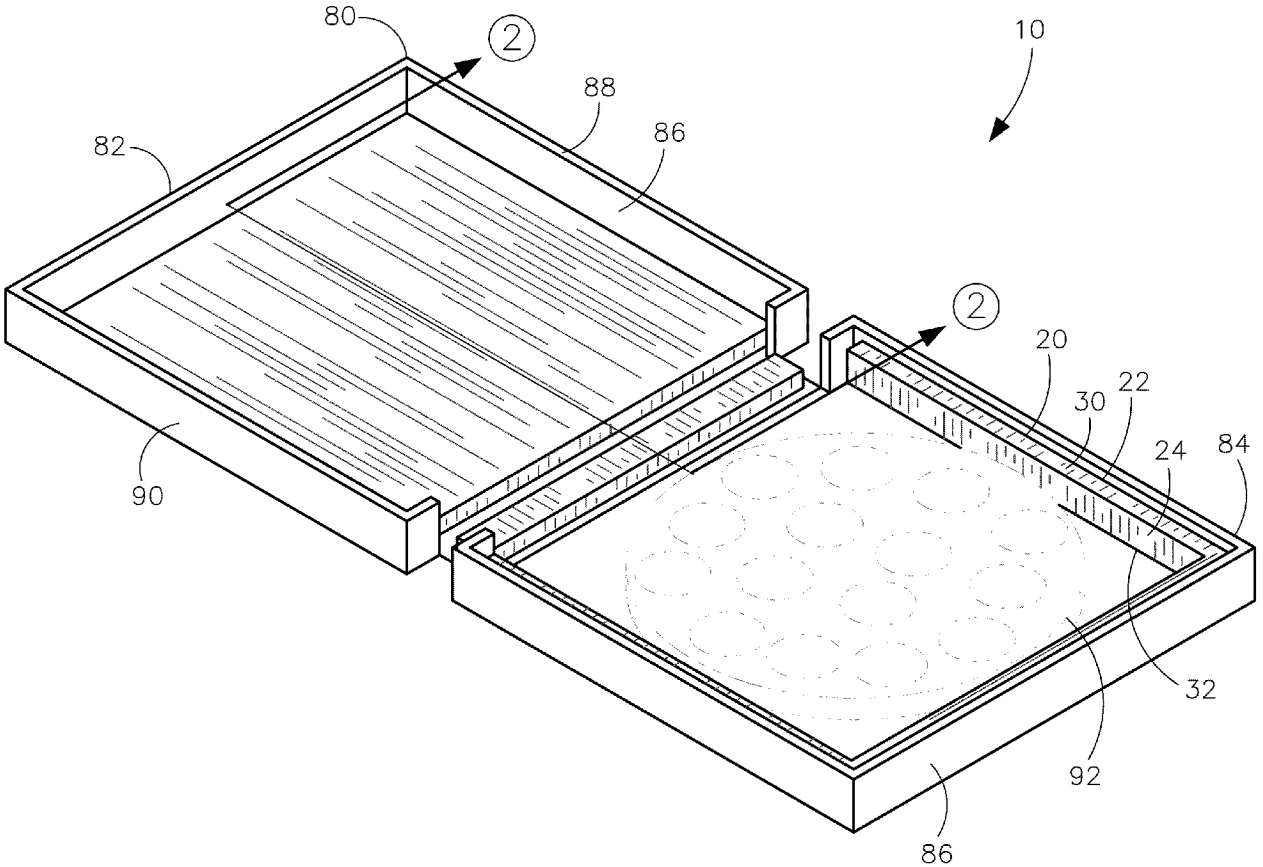
FIG. 1 is a top perspective view showing a moisture-absorbent padding apparatus, positioned within an existing cardboard pizza box, in accordance with the present invention.
Figures 2, 2A, 3:
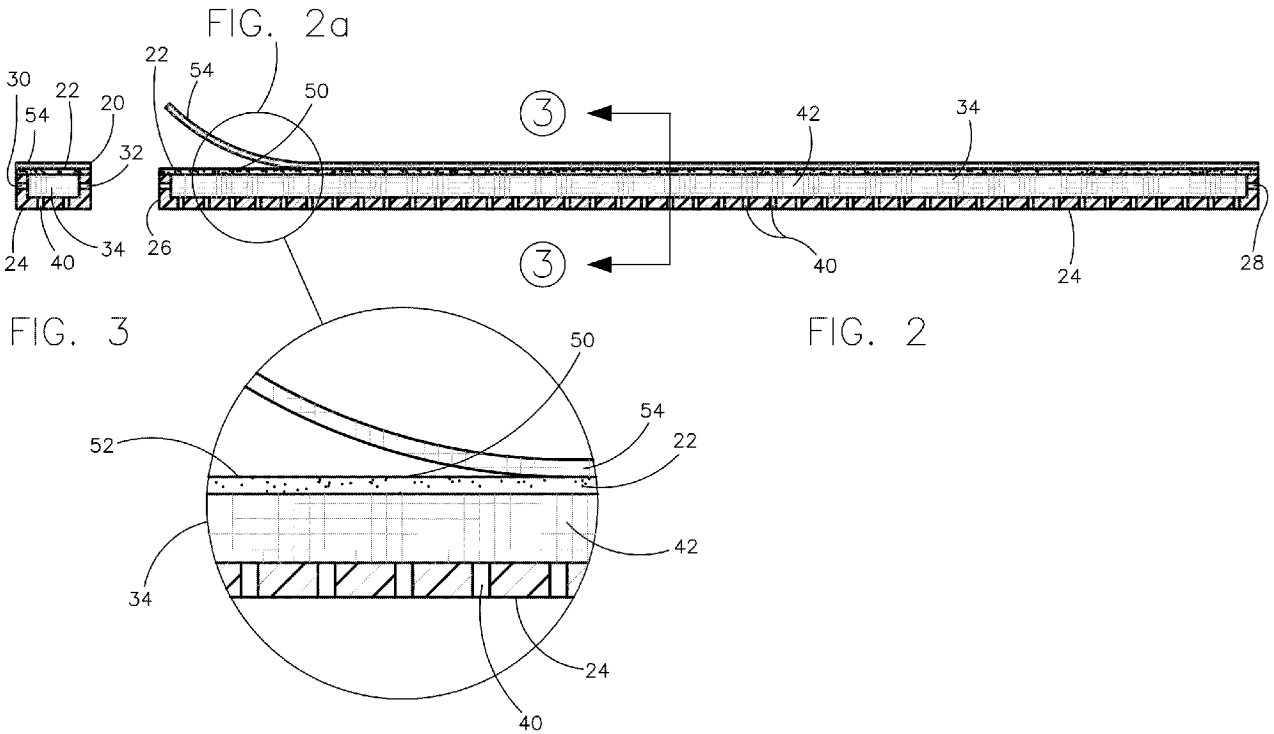
FIG. 2 is a cross-section view taken along line 2-2 of FIG. 1 illustrating vertically oriented orifices.
FIG. 2*a* is an enlarged view of section 2*a* circled in FIG. 2.
FIG. 3 is a cross-section view taken along line 3-3 of FIG. 2.
Figures 4, 4A, 5:
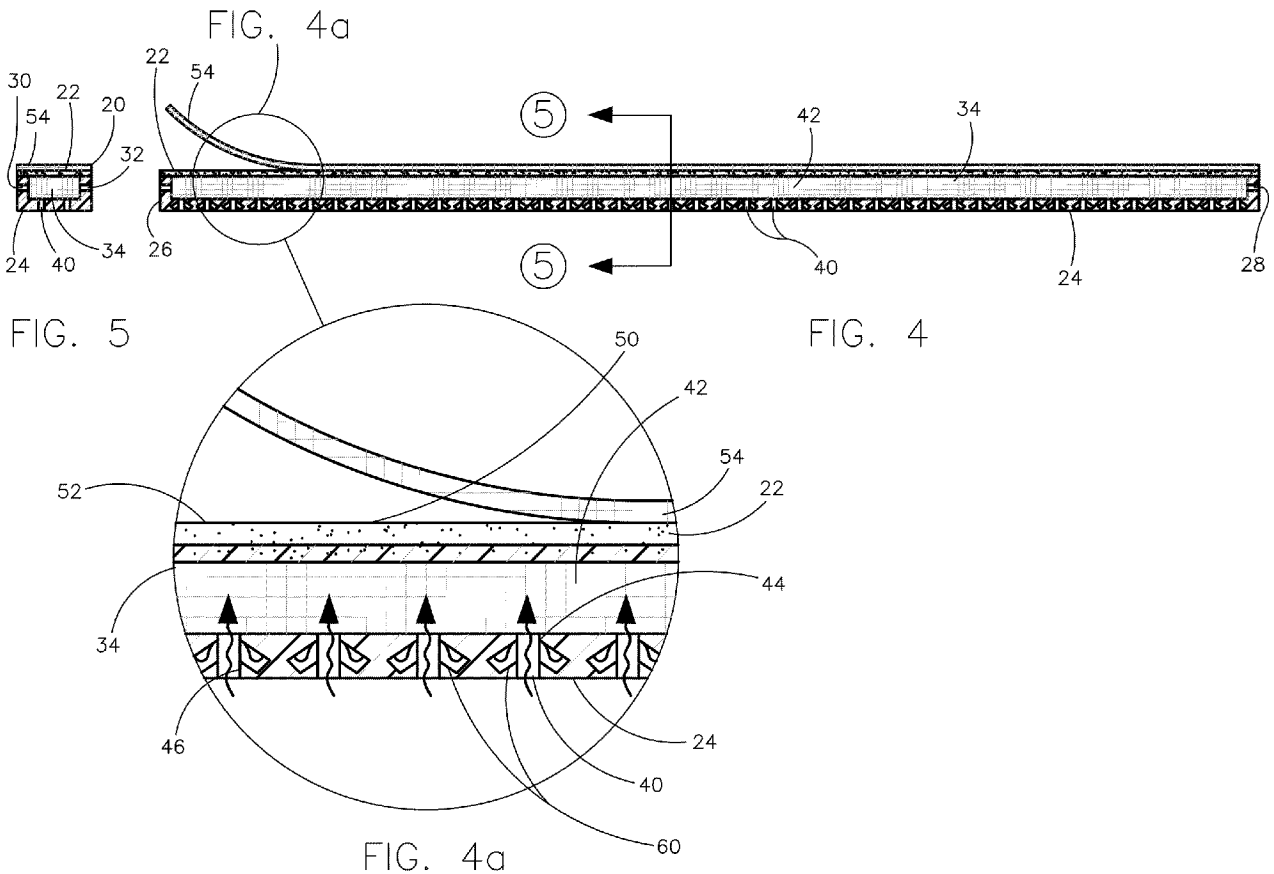
FIG. 4 is a cross-section view illustrating an alternate embodiment provided with vertically oriented orifices and further including laterally flanging reservoirs.
FIG. 4*a* is an enlarged view of section 4*a* circled in FIG. 4.
FIG. 5 is a cross-section view taken along line 5-5 of FIG. 4.
Figure 6:
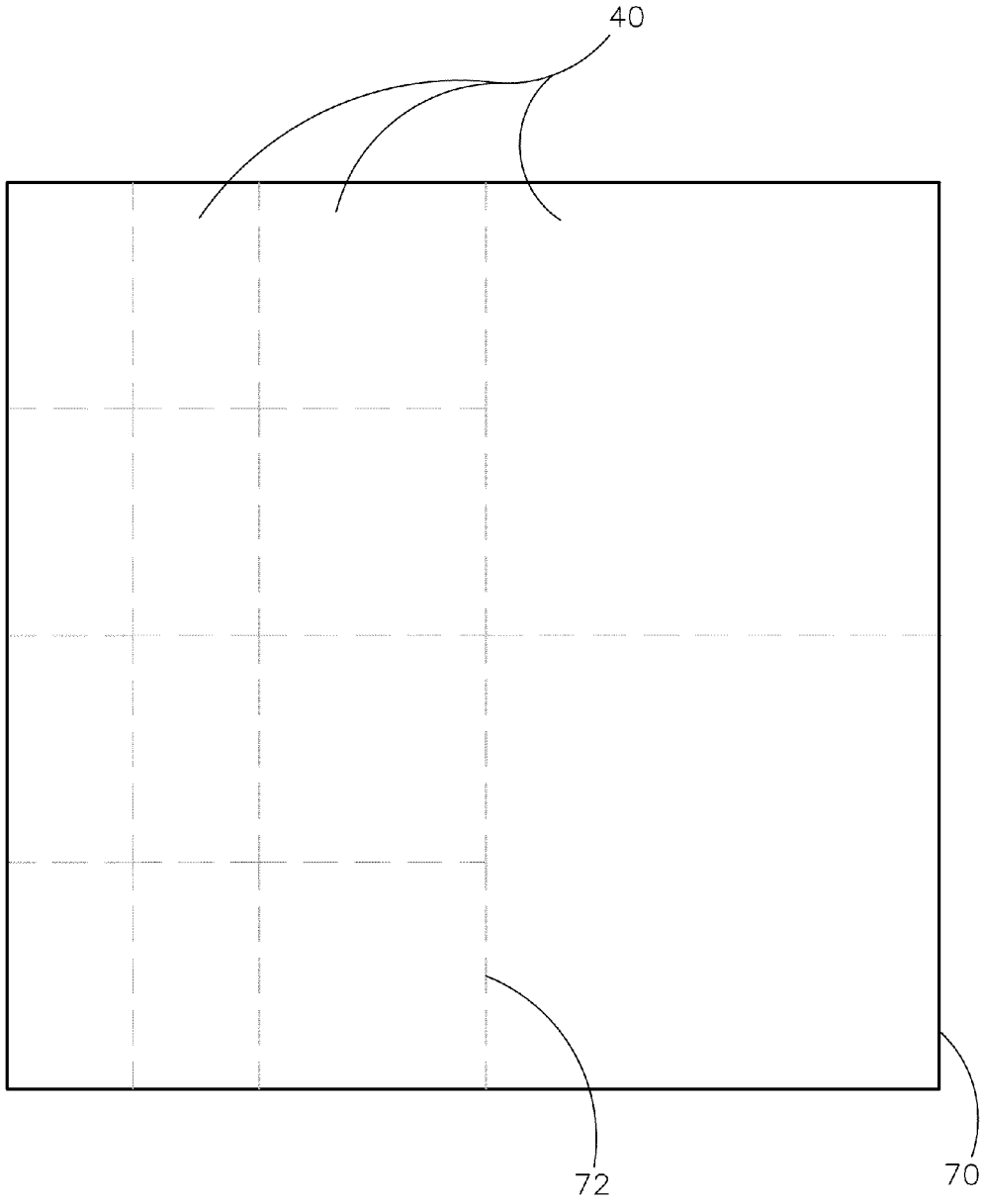
FIG. 6 is top plan view showing a perforated sheet of the moisture-absorbent padding wherein the perforated lines represent lines of weakness along which predetermined sections are separable from the sheet.

The present moisture-absorbent padding apparatus is referred to generally in FIGS. 1 through 6 by the reference numeral 10 and is intended to provide a moisture-absorbent padding for a food product container 80, such as a pizza box. As a durably constructed line of absorbent strips specially designed to capture steam as it rises from the food when in a delivery or carryout box, the present invention prevents the steam from being reabsorbed by the food. As a result, the pizza pie remains perfectly fresh and crispy, as oppose to soggy and unappetizing. Pizza lovers appreciate opening their delivered container to find a piping hot, perfect tasting pizza. Able to immediately dig in with gusto, the present invention allows pizza lovers to relish in the food's just-out-of-the-oven freshness.

The present moisture-absorbent padding apparatus 10 includes a plurality of parallelepiped semi-flexible strips 20. Each strip 20 has a rear wall 22, a front wall 24, a first end 26, a second end 28, a top side 30, a bottom side 32, and a continuous cavity 34 between the rear wall 22, the front wall 24, the first end 26, the second end 28, the top side 30, and the bottom side 32. A plurality of vertically oriented monolithic orifices 40 equidistantly disposed within the front wall 24 of each strip 20. Each orifice 40 opens into the cavity 34. A moisture-absorbent material 42 is disposed throughout the entire cavity 34. The orifices 40 permit moisture released from a food product 92 contained within the container 80 to escape and pass through the orifice 40 into the cavity 34.

A heavy-duty adhesive material 50 continuously coats an outside edge 52 of the rear wall 22. A continuous peel-off backing 54 removably attaches to the rear wall 22 outside edge 52.

The food product container 80 may be formed of cardboard. At least one of the strips 20 lines at least a portion of the container 80. The container 80 has an upper portion 82, a lower portion 84, and an outer wall 86 of each of the upper portion 82 and lower portion 84. The outer wall 86 has an inside edge 88 and an outside edge 90. At least one of the strips 20 removably attaches to the inside edge 88 of the container 80 outer wall 86. The moisture-absorbent material 42 absorbs an amount of moisture released from a food product 92, such as a pizza, contained within the container 80.

The strip 20 may a length of about 6 inches, a width of about 6 inches and a depth of about ¼ inch. In another embodiment of the apparatus 10, the strip 20 may have a length in a range of about 6 inches to about 18 inches, a width of about 3 inches to about 9 inches, and a depth in a range of about ⅛ inch to about ½ inch. The strips 20 may disposed adjacent to each other forming a sheet 70 and separated by a plurality of perforations 72 through the sheet 70. Thus, a strip 20 which best conforms to a container 80 outer wall 86 inside edge 88 may be torn from the sheet and attached to the inside edge to line the container 80.

The moisture-absorbent material 42 may be formed from cotton or other moisture-absorbent textile materials, as well known by one skilled in the art. In addition, the container 80 is a conventional cardboard pizza box commonly used to transport hot pizza between remote locations.

Yet another embodiment of the apparatus 10 includes a laterally flanging parallelepiped reservoir 60 downwardly angularly disposed on each of a right side 44 and a left side 46 of each of the orifices 40. Each reservoir 60 collects an amount of moisture released from a food product 92 contained within the container and passing through one of the orifices 40 such that the moisture is prohibited from egressing from the orifices 40 respectively.

In particular, a pair of reservoirs 60 are in fluid communication with a corresponding one of the orifices 40. Each reservoir 60 is formed within the strips 20, respectively. In this manner, corresponding ones of the reservoirs 60 are contiguously abutted with the orifices 40 respectively and thereby maintain direct fluid communication therewith for directing and storing moisture (steam) released from the food product 92 contained within the food product container 80. Notably, the reservoirs 60 have a closed bottom end located within the strips 20 such that the moisture is prohibited from egressing the strips 20 during transit of the food product container 80.

Such a structural configuration provides an unexpected and unpredictable result because moisture (steam) is seeped upwardly through the orifices 40 and thereafter collected in the reservoirs 60 to prevent undesirable dripping back onto the food product 92 stored in food product container 80. In this manner, the present invention 10 solves the problem of moisture soaking the food product 92 prior to human consumption.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined moisture-absorbent padding utilized in conjunction with and for lining a food product container, said combined moisture-absorbent padding and food product container comprising:

a food product container and a moisture-absorbent padding removably coupled thereto, said moisture-absorbent padding comprising a plurality of parallelepiped semi-flexible strips providing with a cavity formed therein respectively, a plurality of vertically oriented orifices equidistantly disposed within each of said strips, said orifices being opened into said cavity respectively, a moisture-absorbent material disposed throughout said entire cavity, an adhesive material continuously coating an outside edge of said cavity, a peel-off backing continuously and removably attached to said outside edge, and a plurality of reservoirs formed within said strips respectively, corresponding one of said reservoirs being contiguously abutted with said orifices respectively and thereby maintaining direct fluid communication therewith for directing and storing moisture released from the food product contained within said food product container, said reservoirs having a closed bottom end located within said strips such that the moisture is prohibited from egressing said strips during transit of the food product container;

wherein at least one of said strips is in line with at least a portion of said food product container;

wherein each of said strips are disposed adjacent to each other thereby forming a sheet, said strips being separated by a plurality of perforations formed within said sheet;

wherein at least one of said strips is removably attached to an inside edge of said food product container outer wall;

wherein said moisture-absorbent material absorbs and retains moisture released from a food product contained within said food product container.

2. The moisture-absorbent padding of claim 1, wherein at least one of said strips is removably attached to said inside edge of said food product container.

3. The moisture-absorbent padding of claim 2, wherein said moisture-absorbent material absorbs and retains moisture from a food product contained within said food product container.

4. The moisture-absorbent padding of claim 3, wherein each of said strips comprises: a rear wall, a front wall, a first end, a second end, a top side, a bottom side, said cavity being continuously located between said rear wall, said front wall, said first end, said second end, said top side, and said bottom side.

5. The moisture-absorbent padding of claim 4, wherein said food product container comprises: an upper portion, a lower portion, an outer wall of each of said upper and lower portions, said outer wall having said inside edge and said outside edge respectively.

* * * * *